US007246866B2

(12) United States Patent
Mizrahi

(10) Patent No.: US 7,246,866 B2
(45) **Date of Patent: *Jul. 24, 2007**

(54) DRAWER STOP DEVICE WITH DUAL-SIDE MOUNTABLE ROLLER

(76) Inventor: Shalom Mizrahi, 390 Sky Top Dr., Fairfield, CT (US) 06825

( * ) Notice: Subject to any disclaimer, the term of this patent is extended or adjusted under 35 U.S.C. 154(b) by 401 days.

This patent is subject to a terminal disclaimer.

(21) Appl. No.: 10/425,118

(22) Filed: Apr. 29, 2003

(65) Prior Publication Data

US 2004/0217679 A1 Nov. 4, 2004

(51) Int. Cl.
*A47B 88/00* (2006.01)

(52) U.S. Cl. ..... 312/330.1

(58) Field of Classification Search ..... 312/330.1, 312/334.1, 334.7, 334.8, 334.12, 334.18, 312/334.33, 311, 322, 334.21; 16/82; 384/19, 384/20

See application file for complete search history.

(56) References Cited

U.S. PATENT DOCUMENTS 2,223,071 A * 11/1940 Koch ..... 312/334.25
3,094,363 A * 6/1963 Gorton et al. ..... 312/334.4
3,112,960 A * 12/1963 Hillson et al. ..... 384/19
4,183,437 A * 1/1980 Crawford et al. ..... 211/41.8
4,605,265 A * 8/1986 Bessinger et al. ..... 384/20
4,645,359 A * 2/1987 Nelson ..... 384/19
5,692,816 A * 12/1997 Lai ..... 312/334.4
5,860,717 A * 1/1999 Mizrahi ..... 312/322
6,142,596 A * 11/2000 Carson ..... 312/334.39

* cited by examiner

*Primary Examiner*—David R. Dunn
*Assistant Examiner*—Sarah B. McPartlin
(74) *Attorney, Agent, or Firm*—Evelyn M. Sommer

(57) ABSTRACT

A drawer stop device having a dual-sided mounting portion and an interchangeably mountable roller element is used for both left and right-sided mounting for performing a bump-stop function on a sliding cabinet drawer. The mounting portion has a Z-shape or 3-flanged shape, including a first, horizontal flange provided with a row of mounting holes therein, a second, vertical flange perpendicular to the first horizontal flange and provided with another row of mounting holes therein, and a third, horizontal flange perpendicular to the second and extending in an opposite horizontal direction from the first and provided with a pair of roller mounting holes on opposite ends thereof. The interchangeable roller element is mounted by a spindle and cap nut assembly to one or the other mounting hole, depending on which handed side of the drawer the device is being mounted to.

10 Claims, 9 Drawing Sheets

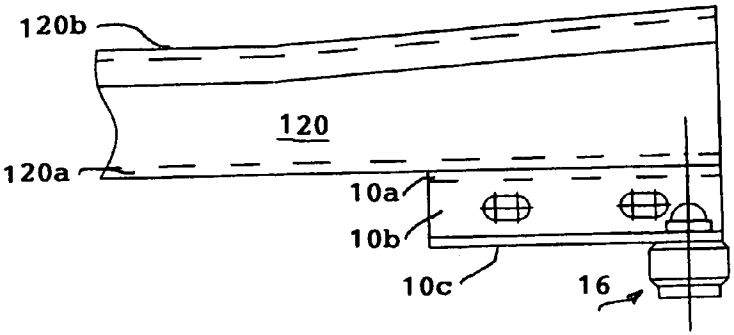
FIG. 8
FIG. 9
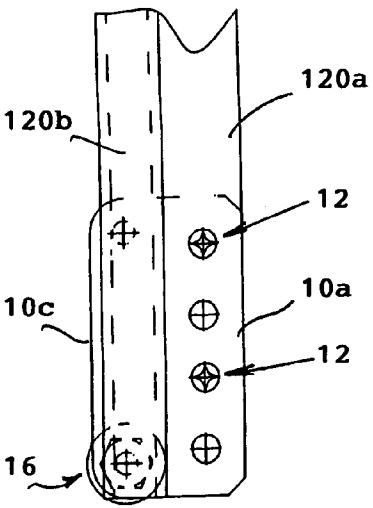
FIG. 10A
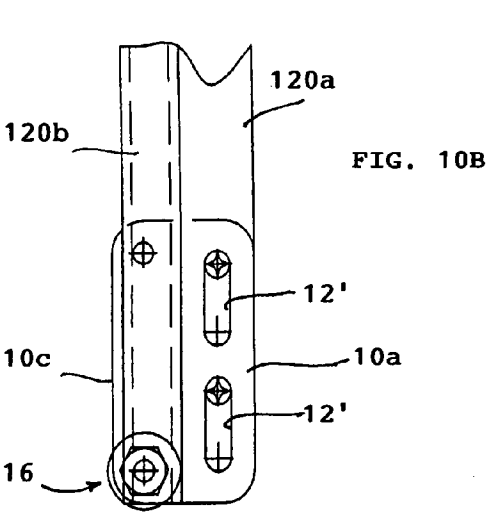
FIG. 10B

DRAWER STOP DEVICE WITH DUAL-SIDE MOUNTABLE ROLLER

This U.S. patent application is a continuation-in-part of U.S. patent application Ser. No. 10/359,807 filed on Feb. 8, 2003 now U.S. Pat. No. 6,779,858, which claims the priority benefit of U.S. Provisional Application No. 60/356,335, filed on Feb. 13, 2002, all of the same inventor.

TECHNICAL FIELD

This invention generally relates to an improvement in a drawer stop device, and more particularly, to a drawer stop device in which a single unit can be used for mounting on two opposite sides of a drawer.

BACKGROUND OF INVENTION

Sliding drawers are commonly built into kitchen cabinets, desks, dining room cabinetry, office furniture, and the like to provide more convenient access to storage space therein. Typically, the drawers are mounted behind cabinet doors which serve to close off and provide a clean, finished, external appearance when the cabinet is not in use. When access into the cabinet is desired, the doors are swung open to a position perpendicular or obtuse to the front plane of the cabinet, clearing the opening to allow a drawer to be slid out from the interior of the cabinet.

However, if the doors are not fully opened, or if they swing back, it often happens that when the drawers are pulled out, their front edges bump against and scratch the inside surface of the doors. This is especially bothersome if the cabinet doors are made of expensive wood or a custom finish. Also, if a drawer is not returned to its fully retracted position, an attempt to close the cabinet doors can cause the doors to bump against the protruding front edges of the drawers. After repeated use, scratch lines and other marks can become gouged into the doors and create an unsightly appearance which is difficult to restore.

In U.S. Pat. No. 5,860,717 issued Jan. 19, 1999 to the same inventor, a drawer stop device is disclosed for preventing the edges of sliding drawers from bumping against and scratching the inside surface of cabinet doors when the drawers are pulled out. In one embodiment shown in FIGS. 1, 2A, 2B, and 2C, the prior drawer stop device 10 is mounted to sliding drawers 20 in a cabinet 30. The cabinet 30 has a front opening 31 and at least one front door 32 vertically hinged (not shown) to one lateral side of the cabinet. The door 32 is movable between a closed position in which it covers the front opening 31 and hides the drawers 20 when they are slidingly retracted to a retracted position into the interior of the cabinet, and a fully open position (shown in FIG. 1) which allows clearance for the drawers to be slidingly extended out through the front opening 31 of the cabinet.

Each sliding drawer 20 has a front panel 21 horizontally elongated with opposite ends spaced apart by a given width, a bottom panel 22, and opposed side walls 23 which are fixed together in an open quadrangular shape defined with opposite vertical front edges 24. The drawer stop device 10 has a flat mounting portion 11 fixed to a bearing portion 12. The bearing portion 12 includes a bearing flange (also 12) which projects perpendicularly from the mounting portion and a roller element 13 rotatably mounted on a vertical mounting axis defined on an end of the bearing flange 12.

As shown in FIGS. 3A and 3B, the stop device is mounted in one preferred way by fixing its mounting portion 11 to a front surface of the front panel 21 of the drawer (such as with screws or fasteners) adjacent to the one vertical front edge 24 proximate to the one lateral side of the cabinet to which the door is hingedly mounted. The roller element 13 mounted on the bearing portion 12 of the drawer stop device 10 projects by a predetermined amount beyond the vertical front edge 24 of the drawer so that it will make rolling contact with the door just ahead of the front edge 24. When the drawer 20 is pulled outwardly, the roller element 13 engages the door (direction of arrow AA) with a rolling motion which avoids damage to its surface and prevents sharp contact between the drawer and the door. The roller element can also, with sufficient sliding acceleration of the drawer, act to further open the door outwardly.

The drawer stop device typically might have a height for the mounting portion of 0.5 to 0.75 inch, a length for the bearing portion of about 1.5 to 2.0 inches, and a diameter of the roller element of about 0.5 to 0.75 inches. The roller element can be covered or made entirely of a smooth material, such as a hard nylon or plastic material. When mounted in a proper position, the contact surface of the roller element projects a predetermined amount, e.g., about 1.0 inch, so that it makes rolling contact with the door ahead of the vertical front edge of the drawer.

The drawer stop device may be used in paired set with another device used when retracting the drawer. Referring to FIGS. 3A and 3B, this configuration is useful where the drawer front panel 21 has ends which extend by a small amount of trim laterally beyond the outer side of the side walls 23. If the drawer has a sliding range which can extend beyond the width of the door, then upon retraction the jutting trim can become wedged by the door or may pinch the fingers of a person holding the front edges of the drawer (direction of arrow BB). Therefore, a second drawer stop device 10B of similar construction as the first-mentioned device referenced as 10A is mounted by its mounting portion 11B on the side wall 23 behind the front panel trim. Its bearing portion 12B mounts a roller element 13B such that it projects by a predetermined amount beyond the lateral extent of the trim of the front panel 21. Upon retraction of the drawer, the front edge of the door would be engaged in rolling contact with the roller element 10B and is pushed outwardly by it so as to allow unimpeded retraction of the drawer into the cabinet.

In FIG. 4, another embodiment has drawer stop devices with roller elements 16 mounted on opposite sides at a bottom part of the drawers. As shown in FIGS. 5A, 5B, and 5C, the mounting flange is formed as an integral part of a lateral rail 14 on which the drawer 20 slides, and the bearing portion is a flat piece 15 perpendicular to the lateral rail 14. The lateral rail 14 is mounted on the side walls 23 of the drawer along a bottom part of the drawer. The roller elements 16 are positioned so as to project by a predetermined amount beyond the vertical front edges of the drawers to make rolling contact with the door in the manner described previously.

However, the prior drawer stop device has the disadvantage that each unit is configured to be mounted on either one of the left or right-handed sides of the drawer. This requires two different units to be fabricated for left and right-sided mounting on cabinet drawers. If the drawer stop devices are packaged in sets with both left and right-handed units. If the cabinet has only one door, then only one drawer stop device is mounted on one side of a drawer and the other side unit is wasted. While a single unit could be mounted in regular orientation on one side and the same unit mounted in inverted orientation on the opposite side, this results in an unaesthetic appearance which is not desired.

SUMMARY OF INVENTION

In accordance with the present invention, a drawer stop device is provided as a single unit which can be mounted on both the left and right-handed sides of a drawer. The single unit is provided with mounting holes in a mounting portion thereof which can be used as needed to mount the device in suitable positions on either the left or right-handed side of a drawer. The drawer stop device has dual-side mounting positions for a roller element to be mounted therewith. A single interchangeable roller element is provided with a spindle and cap nut assembly for mounting in either mounting position as required.

In a preferred embodiment, the mounting portion has a Z-shaped or 3-flanged shape for mounting to different parts of a standard sliding drawer as desired. A first, horizontal flange has a row of mounting holes therein, and is perpendicular to a second, vertical flange provided with another row of mounting holes therein. A third, horizontal flange extending in an opposite horizontal direction from the first, horizontal flange has a pair of mounting holes on opposite ends thereof for mounting the single roller element on a spindle axis oriented in the vertical direction. The roller element is mounted by the spindle and cap nut to one or the other mounting hole, depending on which handed side of the drawer the device is being mounted to. With this configuration, the drawer stop device can be mounted by screws or nuts-and-bolts through the mounting holes in the first, horizontal flange to the bottom rail portion of a standard sliding rail unit at the bottom edge of a sliding drawer. The drawer stop device can also be mounted by screws through the mounting holes in the second, vertical flange into the side panel at a position adjacent the front upper edge of the drawer (with the first, horizontal flange overlapped on the upper edge of the drawer) if it is desired to mount the roller element at the upper edge of the drawer instead of at the bottom edge.

The improvement of the present invention thus allows a single drawer stop unit to be used for left and right-sided mounting at either the top or bottom sides of a cabinet drawer with an interchangeably mounted roller element. The drawer stop device can be packaged as a single set with a mounting portion, roller element, and spindle and cap nut assembly for mounting in any desired position. This reduces the number of parts that need to be fabricated or stocked in inventory, as well as providing flexibility to mount the drawer stop device in any desired position for best aesthetic appearance.

Other objects, features, and advantages of the present invention will become apparent from the following detailed description of the invention considered in conjunction with the drawings, as follows:

DESCRIPTION OF THE DRAWINGS

FIG. 8 is a front view of the improved drawer stop device mounted to the bottom portion of a slide rail on a left handed side (mirror image of the right handed side) of a drawer.

FIG. 9 is a side view of the improved drawer stop device mounted to the bottom portion of a slide rail on a left handed side (mirror image of the right handed side) of a drawer.

FIG. 10A is a plan view of the improved drawer stop device mounted to the bottom portion of a slide rail on a left handed side (mirror image of the right handed side) of a drawer, and FIG. 10B shows an alternate version employing 2 slotted mounting holes instead of 4 fixed mounting holes on the top flange.

DETAILED DESCRIPTION OF INVENTION

In accordance with the broad principles of the invention, the drawer stop device is formed as a single unit which can be mounted on both the left or right-handed sides of a drawer, and has dual-side mounting positions for the interchangeable roller element which is mounted with a spindle and cap nut assembly. In the following description, a specific embodiment is described to illustrate the principles of the invention. However, it is to be understood that other variations and modifications thereto may made.

Figure 1:
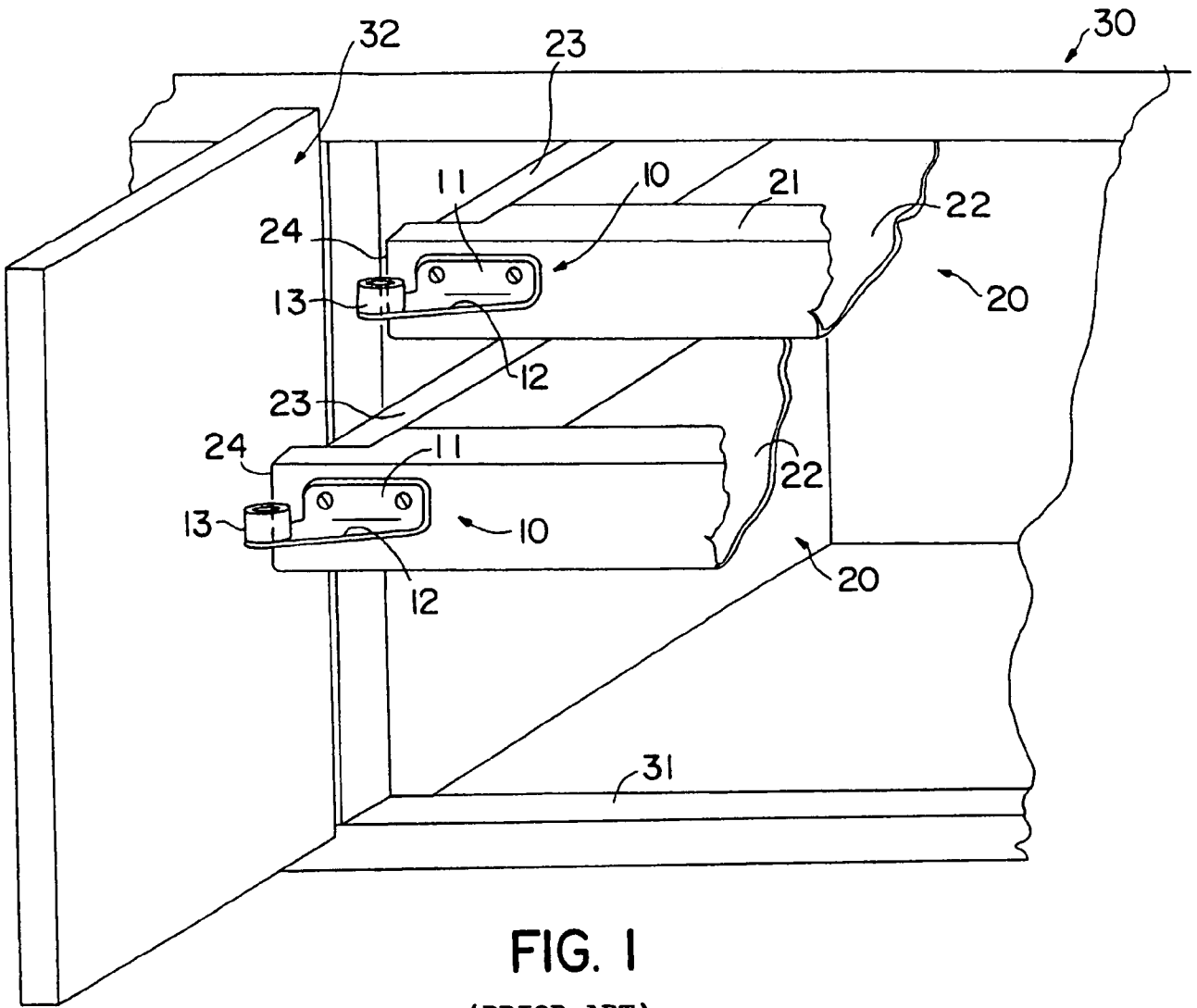
FIG. 1 (PRIOR ART)
FIG. 1 is a front perspective view showing a prior art drawer stop device mounted to the front panels of the drawers of a cabinet in accordance with the invention.
Figure 2A:
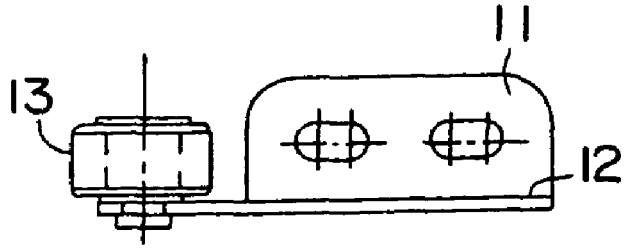
FIG. 2A (PRIOR ART)
FIGS. 2A, 2B, and 2C are front, side, and plane views, respectively, of the prior art drawer stop device of FIG. 1.
Figure 2B:
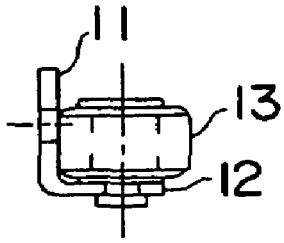
FIG. 2B (PRIOR ART)
Figure 2C:
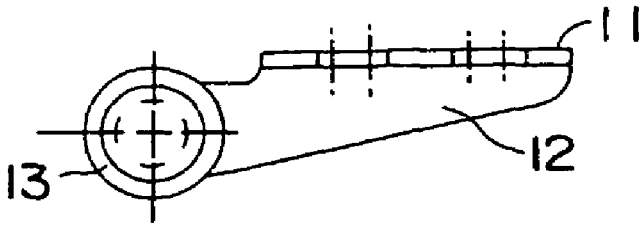
FIG. 2C (PRIOR ART)
Figure 3A:
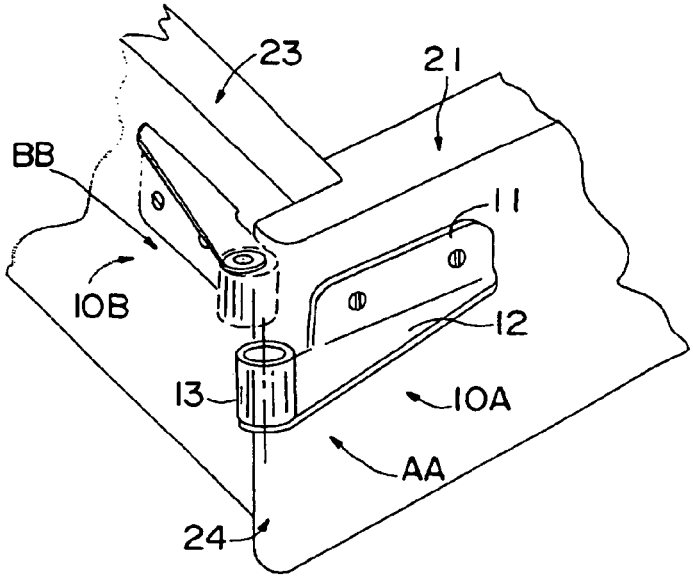
FIG. 3A (PRIOR ART)
FIG. 3A is a front perspective view of a paired set of prior art drawer stop devices mounted to a drawer to rollingly engage a cabinet door in both directions of the drawers sliding movement.
Figure 3B:
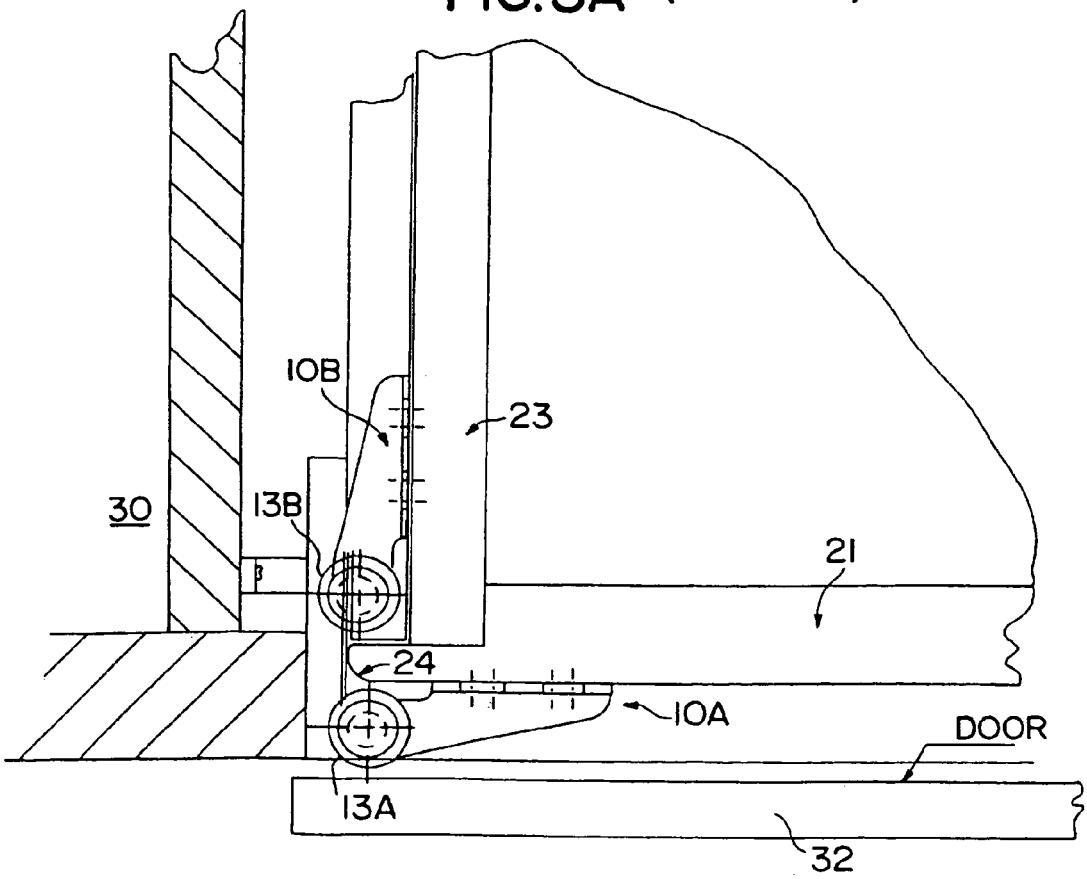
FIG. 3B (PRIOR ART)
FIG. 3B is a plan view thereof.
Figure 4:
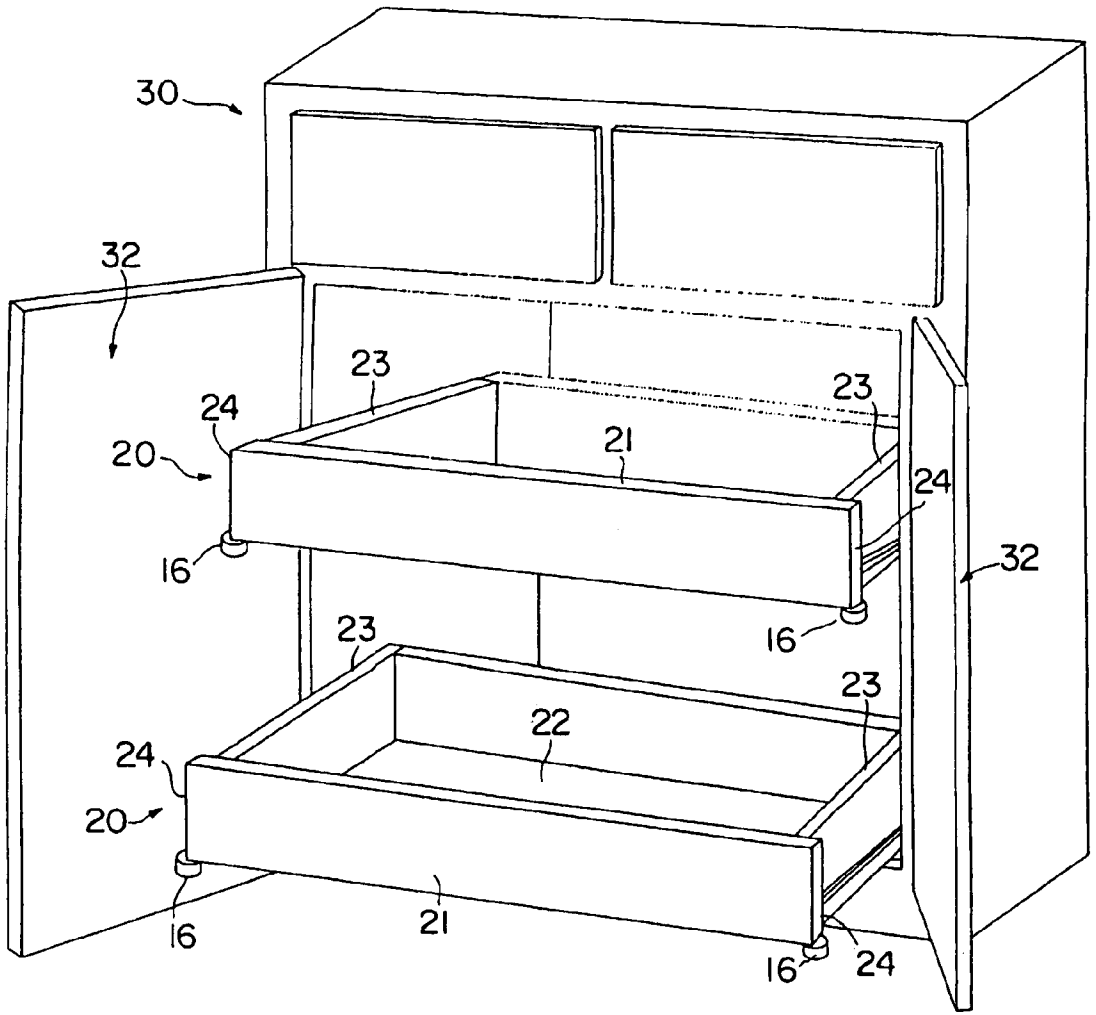
FIG. 4 (PRIOR ART)
FIG. 4 is a front perspective view showing a further embodiment of the prior art drawer stop device mounted to the bottom part of a drawer of a cabinet.
Figure 5A:
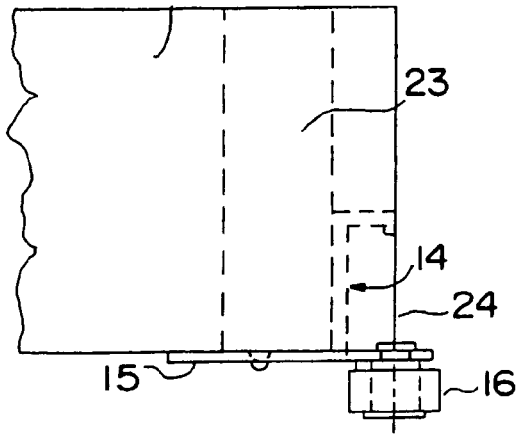
FIG. 5A (PRIOR ART)
FIGS. 5A, 5B, and 5C are front, side, and plan views, respectively, of the prior art drawer stop device mounted to the bottom part of the drawer.
Figure 5B:
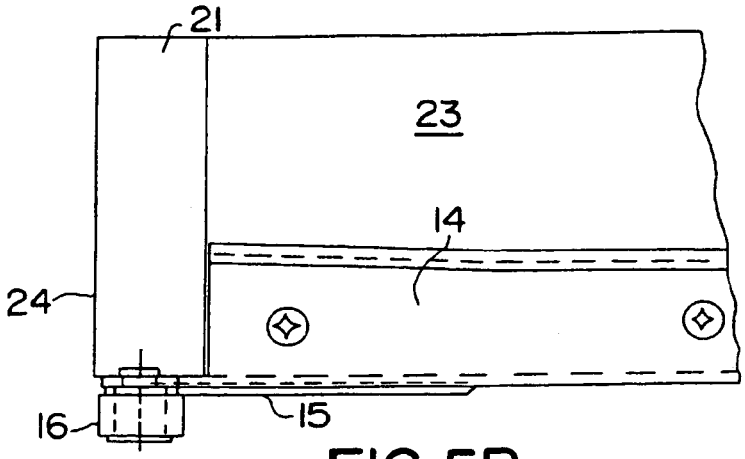
FIG. 5B (PRIOR ART)
Figure 5C:
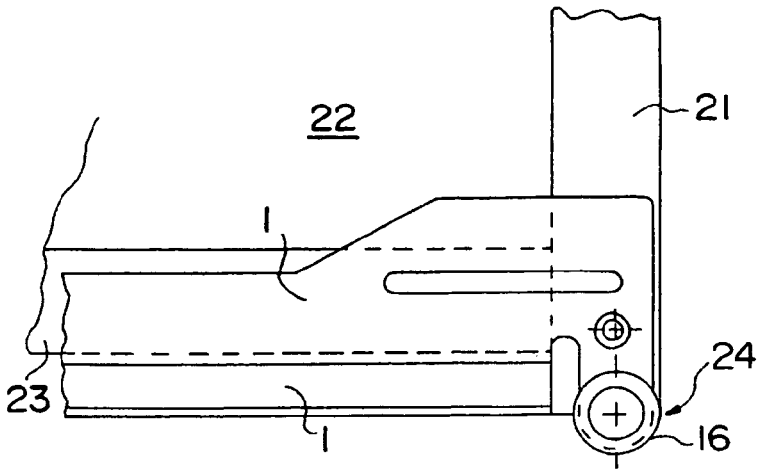
FIG. 5C (PRIOR ART)
Figure 6B:
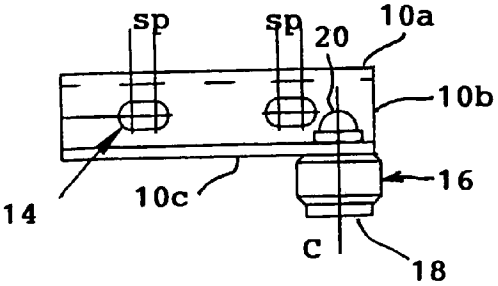
FIGS. 6A, 6B, and 6C are side, front, and plan views, respectively, of the improved drawer stop device in accordance with the present invention.
Figure 6A:
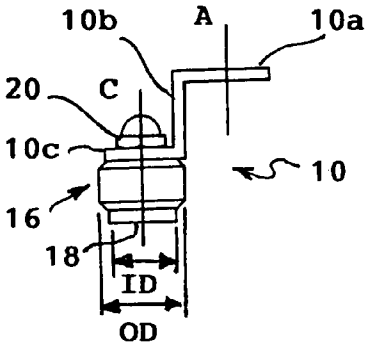
Figure 6C:
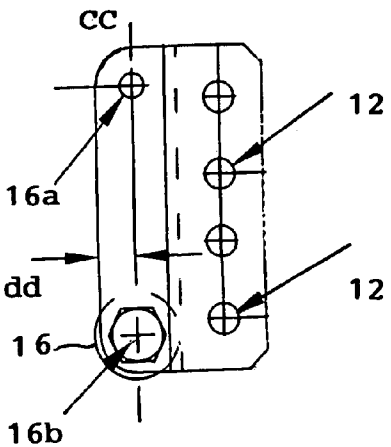

As shown in FIG. 6A-6C, a preferred embodiment of the drawer stop device is formed as a single unit 10 having a Z-shape or 3-flange shape consisting of a first horizontal flange 10*a* with a row of mounting holes 12 therein (aligned with a vertical hole axis A), a second) vertical flange 10*b* perpendicular to the first having another row of mounting holes 14 therein, and a third, horizontal flange perpendicular to the second and extending in an opposite horizontal direction from the first having a pair of mounting holes 16*a*, 16*b* on opposite ends thereof for mounting a single roller element 16 on a spindle axis C oriented in the vertical direction. The roller element is mounted by a spindle 18 and cap nut 20 to one or the other mounting hole, depending on which handed side of the drawer the device is being mounted to. In these figures, the roller element 16 is shown as if it were to be mounted, on the left-handed side of a drawer (as viewed from the front side of the drawer) through the mounting hole 16*b*.

The first, horizontal flange 10*a* is provided in this embodiment with a row of four holes, the use of which is explained further below. The second, vertical flange 10*b* is provided with two slot holes with usable lengths sp, the use of which is explained below. The two roller mounting holes 16*a*, 16*b* are spaced from opposite ends of the third, horizontal flange 10*c* and centered on a horizontal centerline CC spaced from the lateral edge by a distance dd. The roller element has a toroid shape with a wider outer diameter OD in the middle part, and a narrower inner diameter ID at its top and bottom ends. The inner diameter ID is equal to or less than the distance dd (in each radial direction) from the horizontal centerline CC of the third, horizontal flange 10*c* to its lateral edge or to the opposite lateral side which is joined perpendicularly to the second, horizontal flange 10*b*.

Figure 7A:
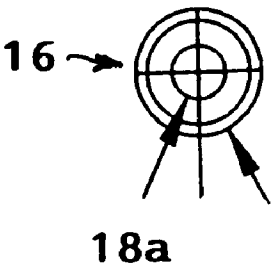
FIGS. 7A, 7B, and 7C are plan and side views of the roller element and side view of the spindle and cap nut assembly used with the improved drawer stop device in the present invention.
Figure 7B:
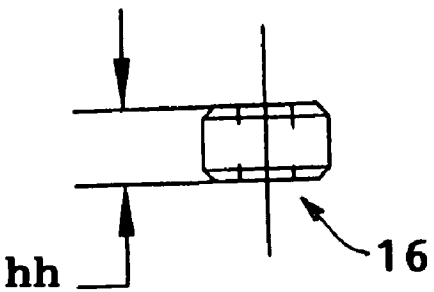
Figure 7C:
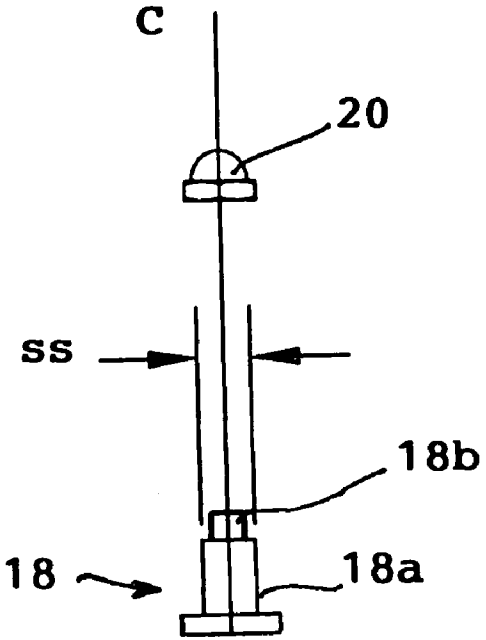

Referring to FIGS. 7A-7C, the spindle and cap nut assembly for mounting the roller element is shown in greater detail. The spindle 18 has an inner shaft 18*a* with a diameter ss which fits thru a central bore (also referred to as 18*a*) in the roller element 16. The inner shaft has a fastener nub 18*b* on its distal end to which the cap nut 20 can be fastened, such as by threading or snap detents, and the like. The shaft 18*a* has a height sufficient to accommodate the height hh of the toroid shaped roller element outer flange without interference with its rotation when the cap nut is secured to the fastener nub 18*b*.

In FIGS. 8 and 9, the improved drawer stop device is shown mounted to the bottom portion 120*a* of a slide rail 120 mounted on a left handed side of a drawer. The slide rail 120 is of a standard type having a top slide rail element 120*b* which slides on rollers mounted to the side of the cabinet to allow the drawer to slide in and out. The drawer stop device can be mounted to the bottom portion 120*a* with two nut-and-bolt fasteners 122 secured through holes drilled through the bottom portion and corresponding two of four fixed mounting holes 12 in the first, horizontal flange 10*a*. In the position shown, the roller element 16 protrudes by the difference of its outer diameter OD over its inner diameter ID on both the front side of the drawer and at the lateral side of the drawer, so that it can provide the bump-stop function both when the drawer is pulled out past the cabinet door and retracted in with the cabinet door opened wide. FIG. 10A shows a plan view of the improved drawer stop device mounted to the bottom portion of a slide rail on a left handed side (mirror image of the right handed side) of a drawer FIG. 10B shows an alternate version having 2 slotted mounting holes 12' (instead of the 4 fixed mounting holes), allowing the device to be mounted with 2 screws on either side of the drawer adjustably in position.

Figure 12:
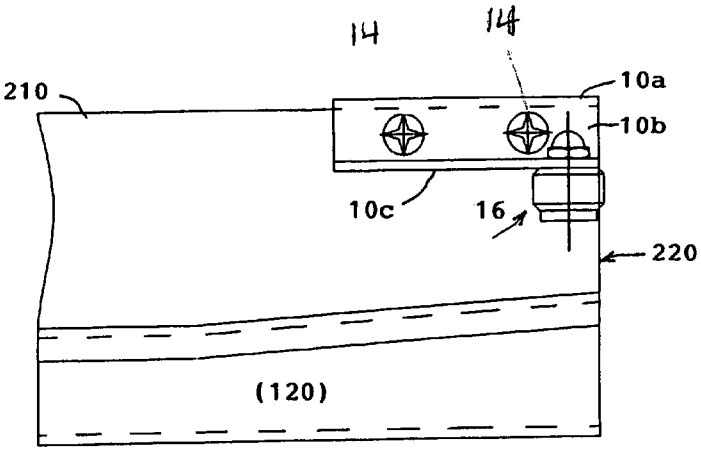
FIG. 12 is a side view of the improved drawer stop device mounted adjacent the top edge on a left handed side (mirror image of the right handed side) of a drawer.
Figure 11:
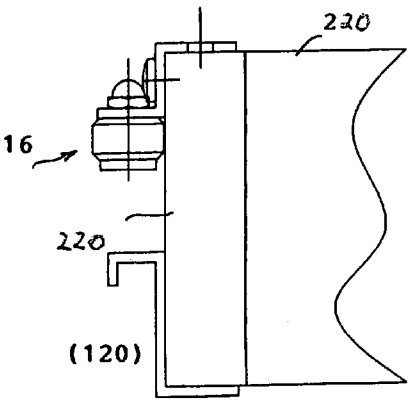
FIG. 11 is a front view of the improved drawer stop device mounted adjacent the top edge on a left handed side (mirror image of the right handed side) of a drawer.
Figure 13B:
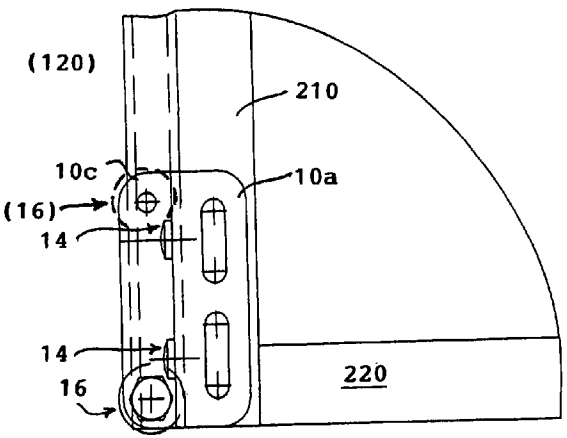
FIG. 13B shows the alternate version having 2 roller elements mounted to the 2 roller mounting holes.
Figure 13A:
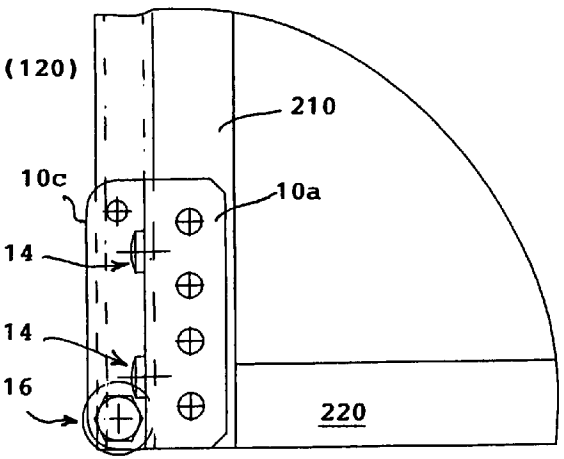
FIG. 13A is a plan view of the improved drawer stop device mounted adjacent the top edge on a left handed side (mirror image of the right handed side) of a drawer.

In FIGS. 11 and 12, the improved drawer stop device is shown mounted adjacent the top edge of the side panel 210 on a left handed side of a drawer. The drawer stop device is mounted by screws 14 secured through the mounting holes in the second, vertical flange 10*b* into the side panel 210 at a position adjacent the upper front edge of the drawer. The first, horizontal flange 10*a* is overlapped on the top edge of the side panel 210. The slide rail 120 for the drawer is indicated in parentheses, as it is not used for mounting the drawer) stop device. In the position shown, the roller element 16 protrudes on both the front side of the drawer and at the lateral side of the drawer, so that it can provide the bump-stop function in both directions of drawer movement. FIG. 13A shows a plan view of the improved drawer stop device mounted to the top edge of the side panel on the left handed side (mirror image of the right handed side) of a drawer. FIG. 13B shows the alternate version of the device (with 2 slotted mounting holes on the top flange) having in this case a second roller (in phantom line) mounted at the opposite roller mounting position so that the same device may be mounted on either side of the drawer without having to disassemble and remount one roller at the opposite position.

In summary, the invention provides a drawer stop device that can be used for both left and right-sided mounting at either the top or bottom sides of a cabinet drawer using an interchangeable roller element. The drawer stop device can be packaged as a single set with a mounting portion, roller element, and spindle and cap nut assembly for mounting in any desired position. This reduces the number of parts that need to be fabricated or stocked in inventory, as well as providing flexibility to mount the drawer stop device in any desired position for best aesthetic appearance.

It is understood that many modifications and variations may be devised given the above description of the principles of the invention. It is intended that all such modifications and variations be considered as within the spirit and scope of this invention, as defined in the following claims.

The invention claimed is:

1. A drawer stop device for use in combination with a sliding drawer mounted in a cabinet behind a door, comprising:

a mounting portion with a Z-shape or 3-flanged shape formed by:

(1) a first, horizontal flange provided with a row of mounting holes therein, (2) a second, vertical flange which is perpendicular to the first, horizontal flange and provided with another row of mounting holes therein, and (3) a third, horizontal flange which is perpendicular to the second, vertical flange and extending in an opposite horizontal direction from the first, horizontal flange and provided with a pair of roller mounting holes on opposite ends thereof;

a pair of roller elements each mounted through a respective one of said pair of roller mounting holes wherein a first of the pair of roller mounting holes is positioned in a front end closer to the cabinet door when the drawer stop device is mounted to a side of the sliding drawer and a second of the pair of roller mounting holes is located rearward and spaced apart from the first of the pair of roller mounting holes, whereby the drawer stop device can be used for left and right-sided mounting interchangeably on a sliding cabinet drawer.

2. A drawer stop device according to claim 1, wherein the mounting holes in the first, horizontal flange are used for mounting drawer stop device to a bottom portion of a standard sliding rail unit mounted at the bottom portion of the sliding cabinet drawer when the drawer stop device is used in combination with a sliding cabinet drawer.

3. A drawer stop device according to claim 2, wherein the mounting holes in the first, horizontal flange are formed in a row and may be selectively used for mounting by nut-and-bolt fasteners to the bottom portion of a standard sliding rail unit mounted at the bottom portion of a sliding cabinet drawer.

4. A drawer stop device according to claim 1, wherein the mounting holes in the second, vertical flange are used to mount the drawer stop device to a side panel adjacent a top front side of a sliding cabinet drawer.

5. A drawer stop device according to claim 4, wherein the mounting holes in the second, vertical flange are formed as a pair of elongated slot holes for selective positioning of fasteners secured to the side panel of a sliding cabinet drawer.

6. A drawer stop device according to claim 1, wherein the roller element is mounted to protrude slightly beyond the mounting portion, so that it can provide a bump- stop function without interference with the door in forward and retracting directions of drawer movement when the drawer stop device is mounted on the drawer.

7. A drawer stop device according to claim 1, wherein each of said rollerelements are mounted interchangeably through one roller mounting hole by means of a spindle and cap nut assembly, wherein the spindle has an inner shaft with a diameter which fits through a central bore in the roller element, and a fastener nub on its distal end to which the cap nut is removably fastened, such as by threading or snap detents, to allow removal and remounting through the other roller mounting hole.

8. A drawer stop device according to claim 1, wherein the roller element has a toroid shape with an outer diameter sufficient to protrude beyond the mounting portion and perform a bump-stop function without interference in forward and retracting directions of drawer movement.

9. A drawer stop device according to claim 1 which is packaged as a single set with the mounting portion, the roller elements, and the spindle and cap nut assembly for use in mounting on the left or right-handed side and the top or bottom sides of a sliding cabinet drawer.

10. A drawer stop device according to claim 1, wherein the mounting holes in the first, horizontal flange are fumed as a pair of elongated slot holes for selective positioning of fasteners to mount to the drawer stop device to a bottom portion of a standard sliding rail unit mounted at the bottom side of a sliding cabinet drawer.

* * * * *